US008991411B1

(12) United States Patent
Neuman

(10) Patent No.: US 8,991,411 B1
(45) Date of Patent: Mar. 31, 2015

(54) SCREEN TENT APPARATUS FOR BEACH CHAIR

(71) Applicant: Jospeh Neuman, Monroe, NY (US)

(72) Inventor: Jospeh Neuman, Monroe, NY (US)

( * ) Notice: Subject to any disclaimer, the term of this patent is extended or adjusted under 35 U.S.C. 154(b) by 0 days.

(21) Appl. No.: 14/093,159

(22) Filed: Nov. 29, 2013

(51) Int. Cl.

| | |
|---|---|
| ***E04H 15/02*** | (2006.01) |
| ***A47C 7/62*** | (2006.01) |
| ***A47C 29/00*** | (2006.01) |
| ***A47C 7/66*** | (2006.01) |

(52) U.S. Cl.
CPC ..... *E04H 15/02* (2013.01); *A47C 29/00* (2013.01); *A47C 7/66* (2013.01)
USPC ..... 135/96; 297/184.11; 297/184.14; 297/184.15

(58) Field of Classification Search
CPC .... A47C 29/00; A47C 29/003; A47C 29/006; A47C 7/66; A47C 1/14; E04H 15/02
USPC ..... 135/96; 297/184.1, 184.11, 184.14, 297/184.15; 5/414
See application file for complete search history.

(56) References Cited

U.S. PATENT DOCUMENTS

| | | | | |
|---|---|---|---|---|
| 2,166,832 | A * | 7/1939 | Wenker | 297/184.15 |
| 3,307,565 | A * | 3/1967 | Luccarelli | 108/42 |
| 5,823,217 | A * | 10/1998 | Rice | 135/124 |
| 7,137,660 | B2 * | 11/2006 | Weddington et al. | 296/105 |
| 7,311,355 | B2 | 12/2007 | Fargason, III | |
| 7,527,331 | B2 | 5/2009 | Fargason, III | |
| 7,708,339 | B2 * | 5/2010 | Zapater | 297/184.11 |
| 8,042,865 | B2 | 10/2011 | Fargason, III | |
| 8,453,664 | B2 * | 6/2013 | Parsons et al. | 135/127 |
| 2002/0112752 | A1 * | 8/2002 | Blakney | 135/96 |
| 2009/0039685 | A1 * | 2/2009 | Zernov | 297/16.2 |
| 2013/0221711 | A1 * | 8/2013 | Surek et al. | 297/184.15 |

FOREIGN PATENT DOCUMENTS

| | | | |
|---|---|---|---|
| DE | 3700983 | C1 * | 8/1988 |
| EP | 276660 | B1 * | 7/1991 |

* cited by examiner

*Primary Examiner* — David R Dunn
*Assistant Examiner* — Danielle Jackson
(74) *Attorney, Agent, or Firm* — Williams Intellectual Property; Benjamin F. Williams

(57) ABSTRACT

A screen tent apparatus for beach chair that includes a netting apparatus disposed to overlie a pair of bowed frame members, said bowed frame members attachable to each of a first bar and a second bar releasably securable to the respective head and foot of an extant beach chair, wherein the netting apparatus concavely situates a roof section overlying said beach chair and a pair of side sheets vertically encloses each side of said beach chair, whereby a user is enabled screened comfort in the outdoors and entry of insects to the beach chair and a user seated thereupon is preventable.

1 Claim, 3 Drawing Sheets

SCREEN TENT APPARATUS FOR BEACH CHAIR

BACKGROUND OF THE INVENTION

Various types of Screen tent apparatus for beach chair are known in the prior art. However, what is needed is a screen tent apparatus for beach chair that includes a netting apparatus disposed to overlie a pair of bowed frame members, said bowed frame members attachable to each of a first bar and a second bar releasably securable to the respective head and foot of an extant beach chair, wherein the netting apparatus concavely situates a roof section overlying said beach chair and a pair of side sheets vertically encloses each side of said beach chair, whereby a user is enabled screened comfort in the outdoors and entry of insects to the beach chair and a user seated thereupon is preventable.

FIELD OF THE INVENTION

The present invention relates to a Screen tent apparatus for beach chair, and more particularly, to a Screen tent apparatus for beach chair that includes a netting apparatus disposed to overlie a pair of bowed frame members, said bowed frame members attachable to each of a first bar and a second bar releasably securable to the respective head and foot of an extant beach chair, wherein the netting apparatus concavely situates a roof section overlying said beach chair and a pair of side sheets vertically encloses each side of said beach chair, whereby a user is enabled screened comfort in the outdoors and entry of insects to the beach chair and a user seated thereupon is preventable.

SUMMARY OF THE INVENTION

The general purpose of the Screen tent apparatus for beach chair, described subsequently in greater detail, is to provide a Screen tent apparatus for beach chair which has many novel features that result in a Screen tent apparatus for beach chair which is not anticipated, rendered obvious, suggested, or even implied by prior art, either alone or in combination thereof.

The present screen tent apparatus for beach chair has been devised to expediently enclose a beach chair within a netting apparatus whereby insects are excluded access to a user seated upon said beach chair. The present screen tent apparatus for beach chair is compactly storable, readily portable, and expediently erectable for installation to a beach chair whereby said beach chair is enclosed beach and insects are excluded from a user seated thereupon.

The present screen tent apparatus for beach chair, therefore, includes a first bar and a second bar attachable to a respective frame of an extant beach chair at each of a respective head and foot of said beach chair. Each of the first and second bars is releasably securable to the frame of the beach chair by means of a pair of clip members disposed thereupon, said clip members attachable to the frame of the beach chair whereby said first and second bars are securable in a position parallel with the frame at each of a respective head and foot of the beach chair. Each of the first and second bars includes a pair of apertures disposed thereon.

Each of a first bowed frame member and a second bowed frame member is releasably insertable into each of the pair of apertures disposed upon each of the first and second bars, each of said first and second bowed frame members positional thereat overlying each of a respective longitudinal edge of said beach chair, thereat bowed in tension between each of said first and second bars. Thus, each of the first and second bowed frame members is expediently erectable to create an arced frame overlying the beach chair.

Each of the first and second bowed frame members includes a plurality of interconnectable segments connectable endwise in longitudinal relation whereby each of said first and second bowed frame members is erectable for installation between each of the first and second bars. Each of the first and second bowed frame members includes an elastomeric cord disposed interiorly through each of the plurality of segments, whereby each of the plurality of segments of each of the first and second bowed frame members is attached together and storable in an adjacent relation when detached from the first and second bars and disconnected from longitudinal relation, for convenient disassembly, storage, and portage.

A netting apparatus is supportable atop each of the first and second bowed frame members. The netting apparatus is disposed to enclose the particular beach chair to which the first and second bowed frame members are attached. The netting apparatus includes a pair of arced seams, each of said pair of arced seams disposed to overlie a respective one of the first and second bowed frame members. A roof section is disposed between each of the pair of arced seams, and spans concavely from a first edge, disposed to contact a ground surface underlying the beach chair proximal the foot of said beach chair, to a second edge, disposed to contact the ground surface proximal the head of the beach chair. Each of the pair of side sheets is disposed to vertically enclose the particular beach chair to which the screen tent apparatus for beach chair is installed, each of said pair of side sheets disposed connected to a respective one of the pair of arced seams and vertically oriented on either side of said beach chair to contact the ground surface proximal each longitudinal edge of the beach chair.

To secure the netting apparatus atop the first and second frame members, and ensure contact with the ground surface, each of a plurality of weight members is disposed along a lowermost edge of each of the pair of side sheets. Each of the plurality of weight members maintains the lowermost edge of each of the pair of side sheets in contact with the ground surface atop which the particular beach chair is disposed. The netting apparatus, therefore, is resistant to displacement from the frame by wind, for example.

The netting apparatus therefore prevents passage of insects to a user seated upon the particular beach chair to which the present screen tent apparatus for beach chair is attached.

To enable expedient access to the beach chair, and egress therefrom, a zippered aperture is disposed in at least one of the pair of side sheets wherethrough a user may enter or exit the netting apparatus. In the preferred embodiment herein disclosed, the zippered aperture is contemplated to include a slanted portion, disposed in a position approximately parallel with the back of the beach chair when said back of the beach chair is positioned at a medial elevation, and a horizontal portion parallel with the ground surface atop which the beach chair is disposed. The zippered aperture is therefore openable to enable a seated user to swing the legs through the aperture previous to standing without impeding the motion to stand from a seated or lounging position.

For convenience of storage and access to the various articles and accouterments common to beachgoers, at least one cup holder pocket is disposed interiorly upon at least one of the pair of side sheets, and at least one pocket is likewise interiorly disposed upon at least one of the pair of side sheets, each of said cup holder pocket and at least one pocket disposed for convenient access by a user seated upon the particular beach chair to which the present device is attached.

It should be readily recognized that erection and disassembly of the present screen tent apparatus for beach chair is expediently effected, when desired. The present screen tent apparatus for beach chair is compactly portable and storable.

Thus has been broadly outlined the more important features of the present Screen tent apparatus for beach chair so that the detailed description thereof that follows may be better understood and in order that the present contribution to the art may be better appreciated.

Objects of the present screen tent apparatus for beach chair, along with various novel features that characterize the invention are particularly pointed out in the claims forming a part of this disclosure. For better understanding of the screen tent apparatus for beach chair, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
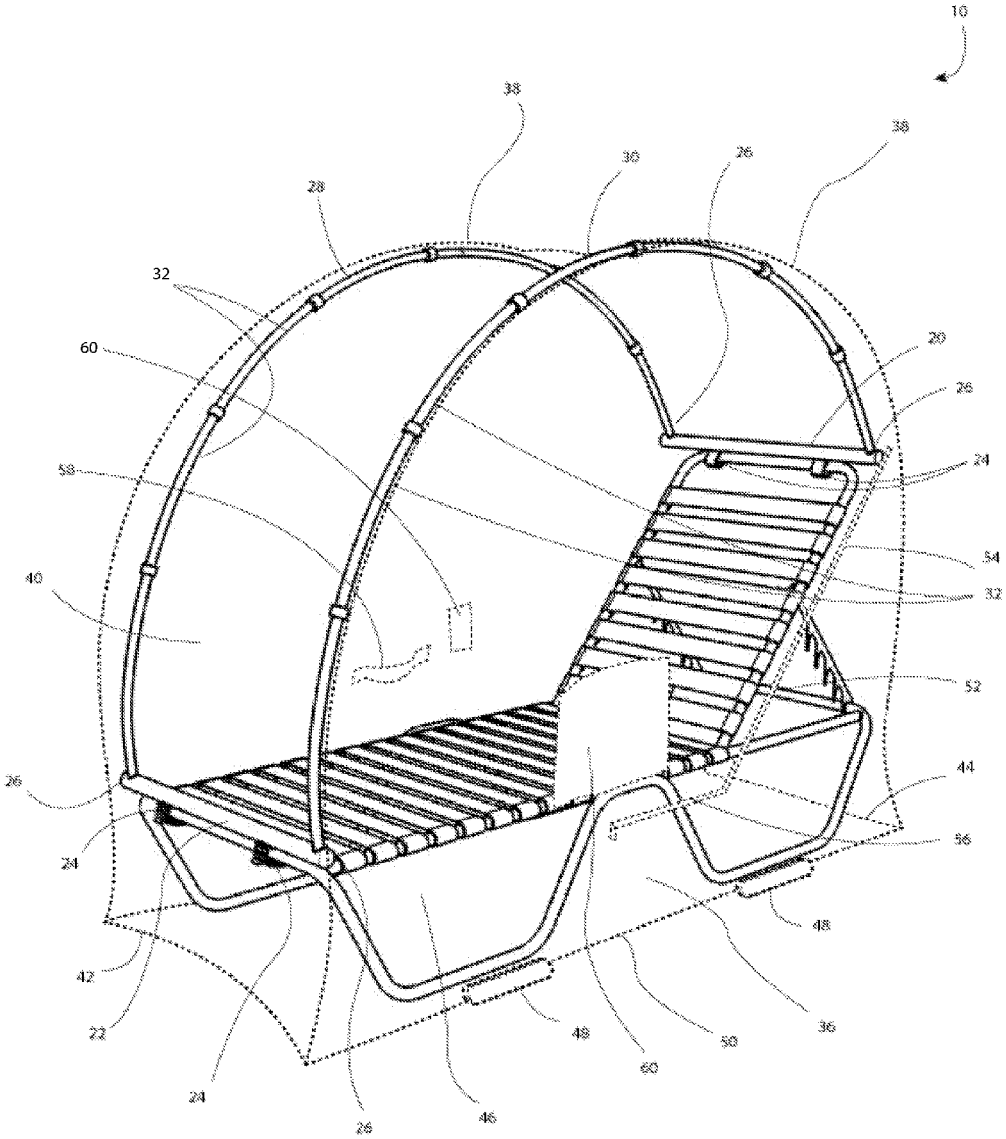
FIG. 1 is an isometric view of a screen tent apparatus for beach chair installed to a beach chair.
Figure 2:
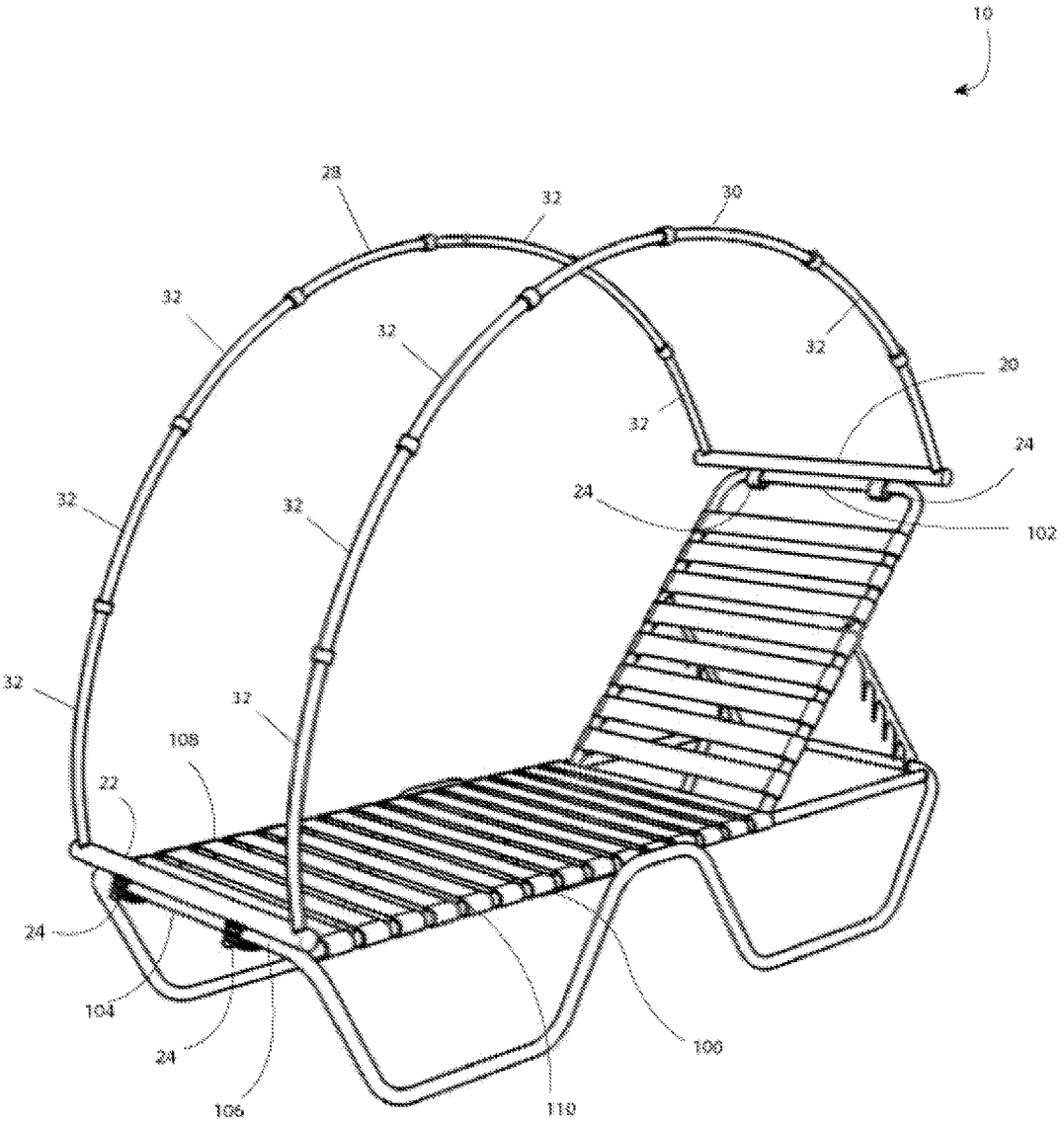
FIG. 2 is an isometric view of a screen tent apparatus for beach chair installed to a beach chair absent a netting apparatus.
Figure 3:
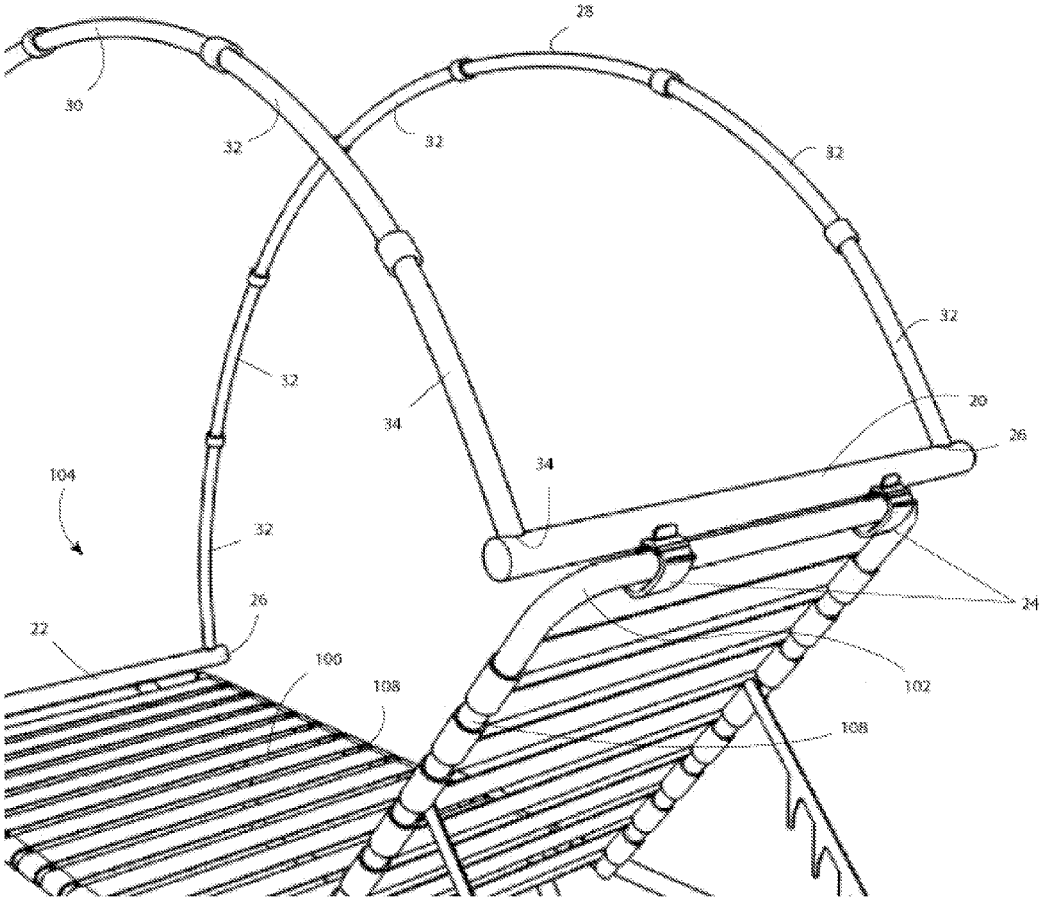
FIG. 3 is a detailed view of a first bar attached at a head of the beach chair.
Figure 4:
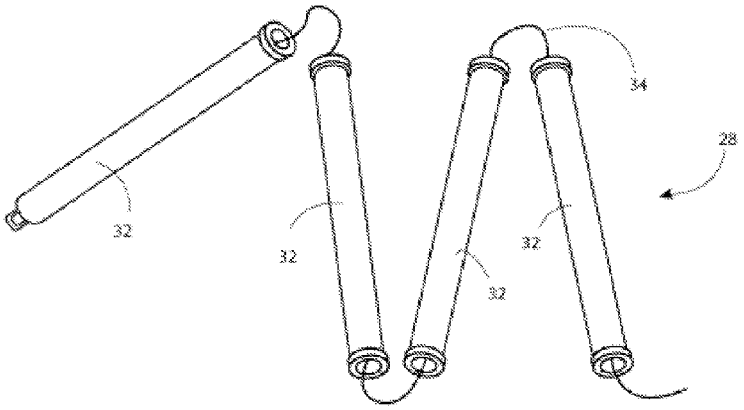
FIG. 4 is a detailed view of a first bowed member with a plurality of interconnectable segments disconnected from a longitudinal relation.

With reference now to the drawings, and in particular FIGS. 1 through 4 thereof, example of the instant screen tent apparatus for beach chair employing the principles and concepts of the present Screen tent apparatus for beach chair and generally designated by the reference number 10 will be described.

Referring to FIGS. 1 through 4 a preferred embodiment of the present screen tent apparatus for beach chair 10 is illustrated.

The present screen tent apparatus for beach chair 10 has been devised to enable a permeable barrier preventative of the passage of insects to a person seated upon a beach chair 100 to which the device 10 is installed. The present screen tent apparatus for beach chair 10 is readily assembled and expediently erected for installation to a beach chair 100 whereby a user is effectively screened from insects otherwise enabled access to said user.

The present screen tent apparatus for beach chair 10, therefore, includes a first bar 20 attachable horizontally to a head 102 of an extant beach chair 100 and a second bar 22 attachable horizontally to a foot 104 of said extant beach chair 100. Each of said first and second bars 20, 22 include a pair of clip members 24 disposed to releasably secure each of said first and second bars 20, 22 to the beach chair 100 in a position parallel with the respective head 102 and foot 104 of said beach chair 100. The clip members 24 releasably fasten around a frame 106 of the extant beach chair 100 and securely retain said first and second bars 20, 22 in a position overlying said frame 106.

Each of the first and second bars 20, 22 includes a pair of apertures 26 disposed thereon, each of said respective pairs of apertures 26 disposed spaced apart at opposite ends of each respective first and second bar 20, 22. A first bowed frame member 28 is attachable to each of the first bar 20 and the second bar 22 by insertion endwise into each of one of said pair of apertures 26 disposed upon each of said first and second bars 20, 22, said first bowed frame member 28 thereby positional to span, bowed in tension, overlying a longitudinal edge 108 of said beach chair.

A second bowed frame member 30 is likewise attachable to each of the first bar 20 and the second bar 22 by insertion into the other of each of the pairs of apertures 26 disposed upon said first and second bar 20, 22. The second bowed member 30 is likewise positional to span, bowed in tension, overlying another longitudinal edge 110 of said beach chair 100.

Each of the first and second bowed frame members 28, 30 includes a plurality of interconnectable segments 32, each of said segments 32 connectable endwise together in longitudinal relation, said first and second bowed frame members 28, 30 thereby connectable tensioned and bowed between each of the respective first and second bars 20, 22. An elastomeric cord 34 is strung interiorly through each of the plurality of segments 32 of each of the first and second bowed frame members 28, 30 whereby said plurality of segments 32 is maintained attached when not connected endwise and disengaged from installation to each of the first and second bars 20, 22.

A netting apparatus 36 is included, said netting apparatus 36 supportable upon the first and second bowed frame members 28, 30. The netting apparatus 36 includes a pair of arced seams 38, each of said pair of arced seams 38 disposed to overlie each respective first and second bowed frame member 28, 30 whereby a roof section 40 is disposed in concave situation overlying the particular beach chair 100 to which the screen tent apparatus for beach chair 10 is installed. The roof section 40 is disposed from a first edge 42, disposed contacting a ground surface most proximal the foot 104 of the beach chair 100, and concavely disposed supported upon each of the first and second bowed frame members 28, 30, to a second edge 44 disposed contacting the ground most proximal the head 102 of said beach chair 100. A pair of side sheets 46 is disposed in vertical relation enclosing the beach chair 100 on each side, whereby an interior space is effectively partitioned from insects in an outdoor environment.

To maintain position of the netting apparatus 36 overlying the particular beach chair 100 to which the device 10 is installed, a plurality of weight members 48 is disposed along a lowermost edge 50 of said netting apparatus 36 upon each of the pair of side sheets 46. The plurality of weight members 48 is positioned to weigh the netting apparatus 36 down under the influence of gravity, said netting apparatus 36 supported upon the first and second bowed frame members 28, 30, whereby the lowermost edge 50 of each of said pair of side sheets 46 is caused to contact a ground surface on either side of the particular beach chair 100 to which the device 10 is installed. The netting apparatus 36 is, therefore, resistant to wind, for example, to maintain position enclosing the particular beach chair 100, and enclose a barrier is effectively around the beach chair 100 whereby passage of insects therethrough is obviated.

To enable entry and egress from the particular beach chair 100 when the present screen tent apparatus for beach chair 10 is installed upon said beach chair 100, a zippered aperture 52 is disposed in one of the pair of side sheets 46. In the present embodiment herein disclosed, the zippered aperture 52 is contemplated to include a slanted portion 54, approximately disposed in parallel relation with a back of the beach chair 100 when said back of the beach chair 100 is positioned at a medial elevation, and a horizontal portion 56 disposed in parallel with the ground surface upon which the chair 100 is disposed. Thus a user may expediently open the zippered aperture 52 to gain access to the beach chair 100, or exit therefrom, when desired.

For convenience of a user seated upon the beach chair 100 when the present screen tent apparatus for beach chair 10 is installed thereto, a cup holder pocket 58 is disposed upon an interior of one of the side sheets 46 of the netting apparatus 36, said cup holder pocket 58 positioned for convenient access proximal a user sitting upon said beach chair 100. At least one pocket 60 is disposed upon the interior of at least one of the pair of side sheets 46, said at least one pocket 60 likewise positioned for convenient access proximal a user sitting upon said beach chair 100 whereby articles and accouterments common to beachgoers are readily storable and accessible, as desired.

Thus, the present screen tent apparatus for beach chair 10 is readily positional to surround a beach chair 100 and protect a user seated upon the beach chair 100 from insects thereby readily excluded passage under the netting apparatus 36. The present screen tent for beach chair 10 is readily collapsible and storable in a compact arrangement, each of the plurality of interconnectable segments 32 of each of the first and second bowed frame members 28, 30 foldable into a stored position, and the netting apparatus 36 foldable whereby the screen tent apparatus for beach chair 10 is readily storable and portable, as desired.

What is claimed is:

1. A screen tent apparatus for a beach chair comprising:

a first bar attachable horizontally to a head of a beach chair;

a second bar attachable horizontally to a foot of said beach chair, each of said first and second bars including:

a pair of clip members disposed to releasably secure each of said first and second bars to a beach chair in parallel with the respective head and foot of said beach chair;

a pair of apertures disposed proximal each end of each respective first and second bars;

a first bowed frame member releasably securable to each of the first bar and the second bar by insertion into one of the each respective pair of apertures, said first bowed frame member thereby positional to span bowed overlying a longitudinal edge of said beach chair;

a second bowed frame member releasably securable to each of the first bar and the second bar by insertion into the other one of each of the respective pair of apertures, said second bowed frame member thereby positional to span bowed overlying another longitudinal edge of said beach chair, each of said first and second bowed frame members comprising:

a plurality of interconnectable segments, each of said segments connectable endwise together in longitudinal relation, said first and second bowed frame members thereby connectable tensioned and bowed between each of the respective first and second bars;

an elastomeric cord disposed interiorly through each of the respective plurality of interconnectable segments, each of said plurality of interconnectable segments thereby remaining attached when disconnected from said longitudinal relation;

a netting apparatus supportable upon the first and second bowed frame members, said netting apparatus including:

a pair of arced seams, each of said pair of arced seams disposed to overlie a respective one of the first and second bowed frame members;

a roof section disposed between each of said pair of arced seams, said roof section disposed concavely between a first edge, disposed to contact a ground surface most proximal the foot of the beach chair, and a second edge, disposed to contact the ground most proximal the head of said beach chair;

a pair of side sheets disposed vertically enclosing the beach chair on either side;

a plurality of weights disposed along a lowermost edge of each of said pair of side sheets, said weights positioned thereat to weigh the netting apparatus, supported by the first and second bowed frame members, with the lowermost edge contacting a ground surface;

a zippered aperture disposed to enable entrance and exit to the beach chair, said zippered aperture including a first portion disposed angularly in a position proximally parallel with a back of a beach chair, when said back is elevated to a medial height, and a second portion disposed horizontally in a position parallel with the ground surface upon which said beach chair is disposed;

a cup holder pocket disposed interiorly upon one of the pair of side sheets, said cup holder pocket positioned for convenient access proximal a user resting upon said beach chair; and at least one pocket disposed interiorly upon at least one of the pair of side sheets, said at least one pocket positioned for convenient access proximal a user resting upon said beach chair;

wherein the netting apparatus is positional to surround the beach chair and a user seated upon the beach chair is protected from insects excluded from entry under the netting apparatus.

* * * * *